US007612752B2

(12) United States Patent
Chen et al.

(10) Patent No.: US 7,612,752 B2
(45) Date of Patent: Nov. 3, 2009

(54) FLAT PANEL DISPLAY AND PIXEL DRIVING METHOD APPLIED THERETO

(75) Inventors: Shyh-Feng Chen, Hualien County (TW); Kuei-Sheng Tseng, Taoyuan County (TW); Lee-Hsun Chang, Yunlin County (TW); Wen-Bin Chen, Changhua County (TW)

(73) Assignee: Au Optronics Corp., Hsin-Chu (TW)

( * ) Notice: Subject to any disclaimer, the term of this patent is extended or adjusted under 35 U.S.C. 154(b) by 534 days.

(21) Appl. No.: 11/467,961

(22) Filed: Aug. 29, 2006

(65) Prior Publication Data

US 2007/0229427 A1 Oct. 4, 2007

(30) Foreign Application Priority Data

Mar. 31, 2006 (TW) ..... 95111675 A

(51) Int. Cl.
*G09G 3/36* (2006.01)

(52) U.S. Cl. ..... 345/94; 345/92

(58) Field of Classification Search ..... 345/82–110, 345/205–208

See application file for complete search history.

(56) References Cited

U.S. PATENT DOCUMENTS 4,938,566 A * 7/1990 Takeda et al. ..... 349/39
5,408,252 A * 4/1995 Oki et al. ..... 345/205
5,805,248 A * 9/1998 Sakamoto et al. ..... 349/48
6,414,665 B2 7/2002 Libsch et al.
6,476,787 B1 11/2002 Libsch et al.
2004/0004606 A1* 1/2004 Kodate et al. ..... 345/204
2004/0263760 A1* 12/2004 Kodate et al. ..... 349/151
2005/0083319 A1 4/2005 Kodate et al.

FOREIGN PATENT DOCUMENTS

| | | |
|---|---|---|
| CN | 1278073 | 12/2000 |
| CN | 1357872 | 7/2002 |
| TW | 575762 | 2/2004 |
| TW | 200419227 | 2/2004 |
| TW | 594630 | 6/2004 |

* cited by examiner

*Primary Examiner*—Chanh Nguyen
*Assistant Examiner*—Robert M Stone
(74) *Attorney, Agent, or Firm*—Thomas, Kayden, Horstemeyer & Risley

(57) ABSTRACT

A pixel driving method applied to a flat panel display is provided. In a first time period, an Nth scan line provides a first scan voltage to a pixel row to conduct the corresponding thin film transistors (TFT). Also, an N+1th scan line provides a second scan voltage through the conducted TFTs to the corresponding first switches to conduct the first switches, and then a number of first data voltages of the corresponding data lines are outputted to the corresponding first pixel electrodes. The absolute value of the difference between the first scan voltage and the second scan voltage is not smaller than a threshold voltage of each TFTs.

15 Claims, 9 Drawing Sheets

FLAT PANEL DISPLAY AND PIXEL DRIVING METHOD APPLIED THERETO

This application claims the benefit of Taiwan application Serial No. 95111675, filed Mar. 31, 2006, the subject matter of which is incorporated herein by reference.

BACKGROUND OF THE INVENTION

1. Field of the Invention

The invention relates in general to a flat panel display and a pixel driving method applied thereto, and more particularly to a flat panel display and a pixel multiplexing driving method applied thereto.

2. Description of the Related Art

In a conventional flat panel display, each pixel is connected to a data line and a scan line separately and is provided a corresponding data voltage and an corresponding scan voltage by a driving circuit. Because of the requirements of current market, the size of the flat panel display is getting larger and the resolution is getting higher, so that the cost of the driving circuit and the cost of the flat panel display are getting more. Therefore, the flat panel display with pixel multiplexing structure appears in order to reduce the cost of the display and increase the competitiveness in the market.

Referring to FIG. 1, a pixel multiplexing structure in a conventional flat panel display is shown. Also referring to FIG. 2, a waveform of the signals provided to the scan voltage and the data voltage according to the flat panel display in FIG. 1 is shown. The pixel array 100 adopts the pixel multiplexing method where one data line respectively provides two data voltages to the two pixels adjacent to the data line. The following takes the adjacent two pixels A and B in the Nth pixel row Ln as an example where the adjacent two pixels are connected to the data line Dm and the scan line Gn. First, in the time period from t0 to t1, the scan line Gn provides a scan voltage Vn to the Nth pixel row to conduct the corresponding thin film transistor (TFT) M2. Also, the next scan line Gn+1 provides a scan voltage Vn+1 via the conducted TFT M2 to the corresponding TFT M1 to conduct the TFT M1, thus the TFT M1 outputs a data voltage D1 of the data line Dm to the corresponding pixel A. Besides, the scan voltage Vn outputted by the scan line Gn conducts the corresponding TFT M3, thus the TFT M3 outputs the data voltage D1 of the data line Dm to the corresponding pixel B. Wherein the scan voltage Vn is substantially equal to the scan voltage Vn+1.

However, according to the characteristic of TFT, when the TFT M2 is conducted, the gate voltage of the TFT M1 outputted from the TFT M2 is not equal to the scan voltage Vn+1 provided by the scan line Gn+1. Instead, the gate voltage of TFT M1 is lower than the scan voltage Vn+1 by a threshold voltage. That is, the gate voltage of the TFT M1 is 20V−5V=15V. Moreover, the gate voltage of the TFT M3 is equal to the scan voltage Vn of the scan line Gn (=20V). In other words, when the pixels A and B receive the data voltage D1 in the time period from t0 to t1, the gate voltage of the TFT M1 (=15V) is substantially lower than the gate voltage of the TFT M3 (=20V), such that the charging capability of the pixel A is worse than that of the pixel B. Also, the unequal charging capability between pixel A and B may cause the phenomenon of flickering on the flat panel display.

SUMMARY OF THE INVENTION

It is therefore an object of the invention to provide a flat panel display and a pixel driving method applied thereto in order to solve the problem of unequal voltage between the pixels caused by a pixel multiplexing structure in the flat panel display efficiently, such that the phenomenon of flickering has improved remarkably.

The invention achieves the above-identified object by providing a pixel driving method applied to a flat panel display. First, in a first time period, the scan line provides a first scan voltage to a pixel row to conduct the corresponding thin film transistors (TFTs). Also, the next scan line provides a second scan voltage via the conducted TFTs to the corresponding first switches to conduct the first switches, and the corresponding data line outputs a number of first data voltages to the corresponding first pixel electrodes. The absolute value of the difference between the first scan voltage and the second scan voltage is not smaller than a threshold voltage of TFT Then, in a second time period, the scan line provides a third scan voltage to the pixel row to conduct the corresponding TFTs and the second switches, also the next scan line provides a fourth scan voltage via the conducted TFTs to the corresponding first switches to turn off the first switches. At the same time, the corresponding data line outputs a number of second data voltages via the conducted second switches to the corresponding second pixel electrodes.

The invention achieves the above-identified object also by providing a flat panel display comprising a substrate and a number of pixels. Each pixel has a first sub-pixel and a second sub-pixel. The first sub-pixel has a first pixel electrode, a first switch and a thin film transistor (TFT). The second sub-pixel has a second pixel electrode and a second switch. In a first time period, the scan line outputs a first scan voltage to a pixel row among the pixels to conduct the corresponding TFTs, the next scan line also outputs a second scan voltage via the conducted TFTs to the corresponding first switches to conduct the first switches and the corresponding data lines output a number of first data voltages via the conducted first switches to the corresponding first pixel electrodes. The absolute value of the difference between the first scan voltage and the second scan voltage is not smaller than a threshold voltage of TFT. In a second time period, the scan line provides a third scan voltage to the pixel row to conduct the corresponding TFTs and the second switches, the next scan line also provides a fourth scan voltage via the conducted TFTs to the corresponding first switches to turn off the first switches, at the same time, the corresponding data lines output a number of second data voltages via the conducted second switches to the corresponding second pixel electrodes.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
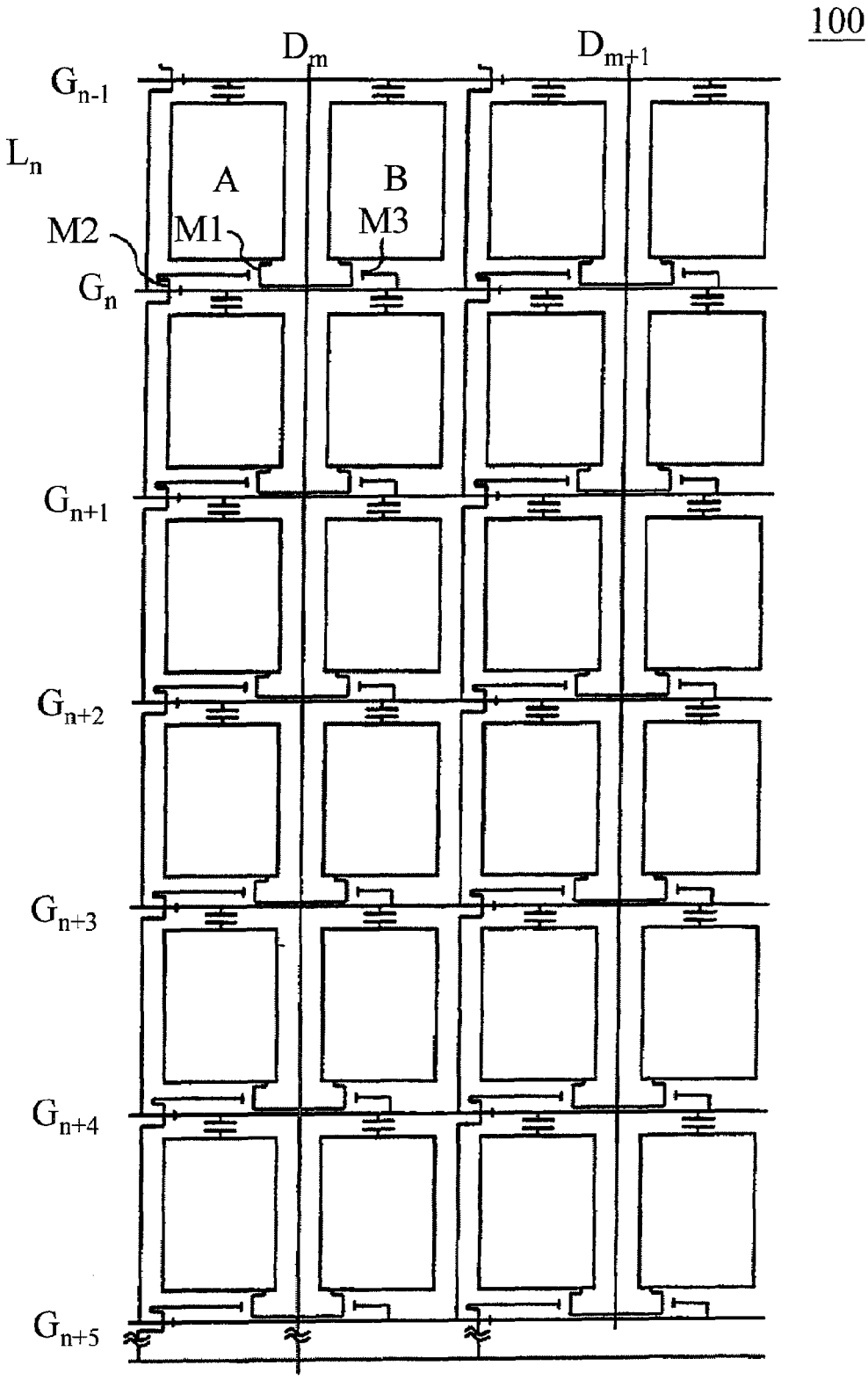
FIG. 1(RELATED ART)
FIG. 1 (Related Art) shows a pixel multiplexing structure in a conventional flat panel display.
Figure 2:
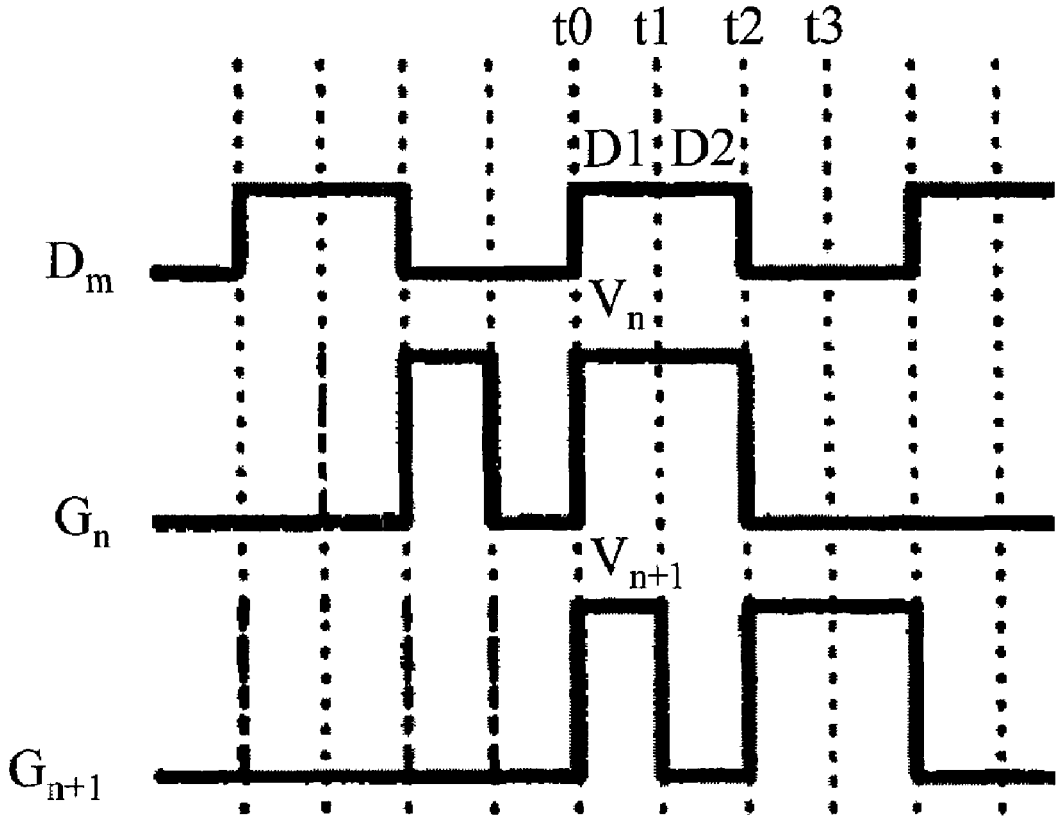
FIG. 2(RELATED ART)
FIG. 2 (Related Art) shows a waveform of the signals provided to the scan voltage and the data voltage according to the flat panel display in FIG. 1.
Figure 3:
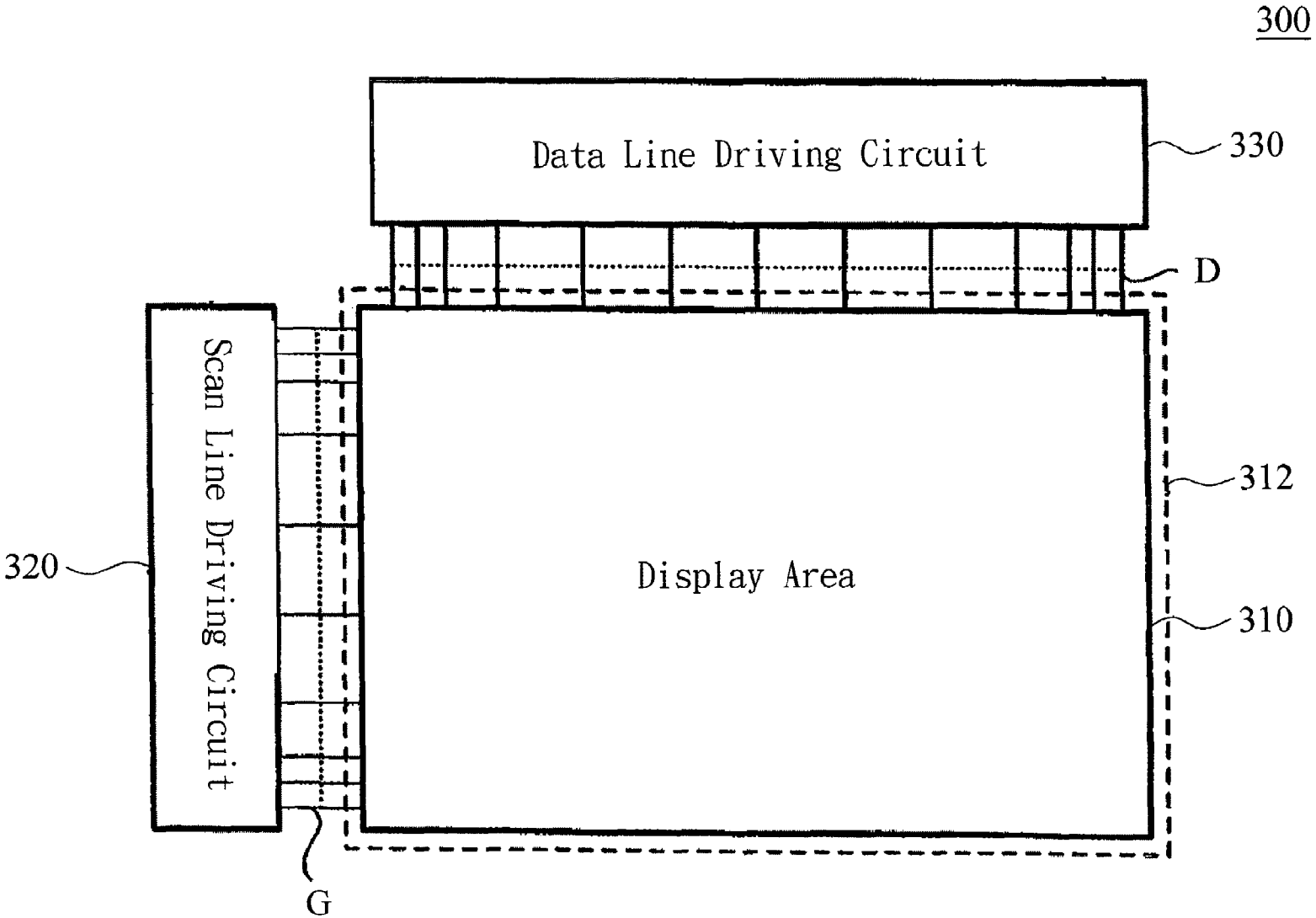
FIG. 3 shows a flat panel display according to a preferable embodiment of the invention.

Referring to FIG. 3, a flat panel display according to a preferable embodiment of the invention is shown. A flat panel display 300, for example, is a liquid crystal display (LCD) comprising a substrate 312, a scan line driving circuit 320 and a data line driving circuit 330. Sited on the substrate 312 are a number of scan lines G, a number of data lines D and a display area 310. The display area 310 is operable to display a frame and has a number of pixel rows (not shown). The scan line driving circuit 320 and the data line driving circuit 330 are separately connected to the display area 310 through the scan lines G and the data lines D. In a normal driving mode, the scan line driving circuit 320 outputs scan voltages through the scan lines G to the substrate 312 to enable the corresponding pixels. The data line driving circuit 330 outputs data voltages through the data lines in order to display the pixels.

Figure 4:
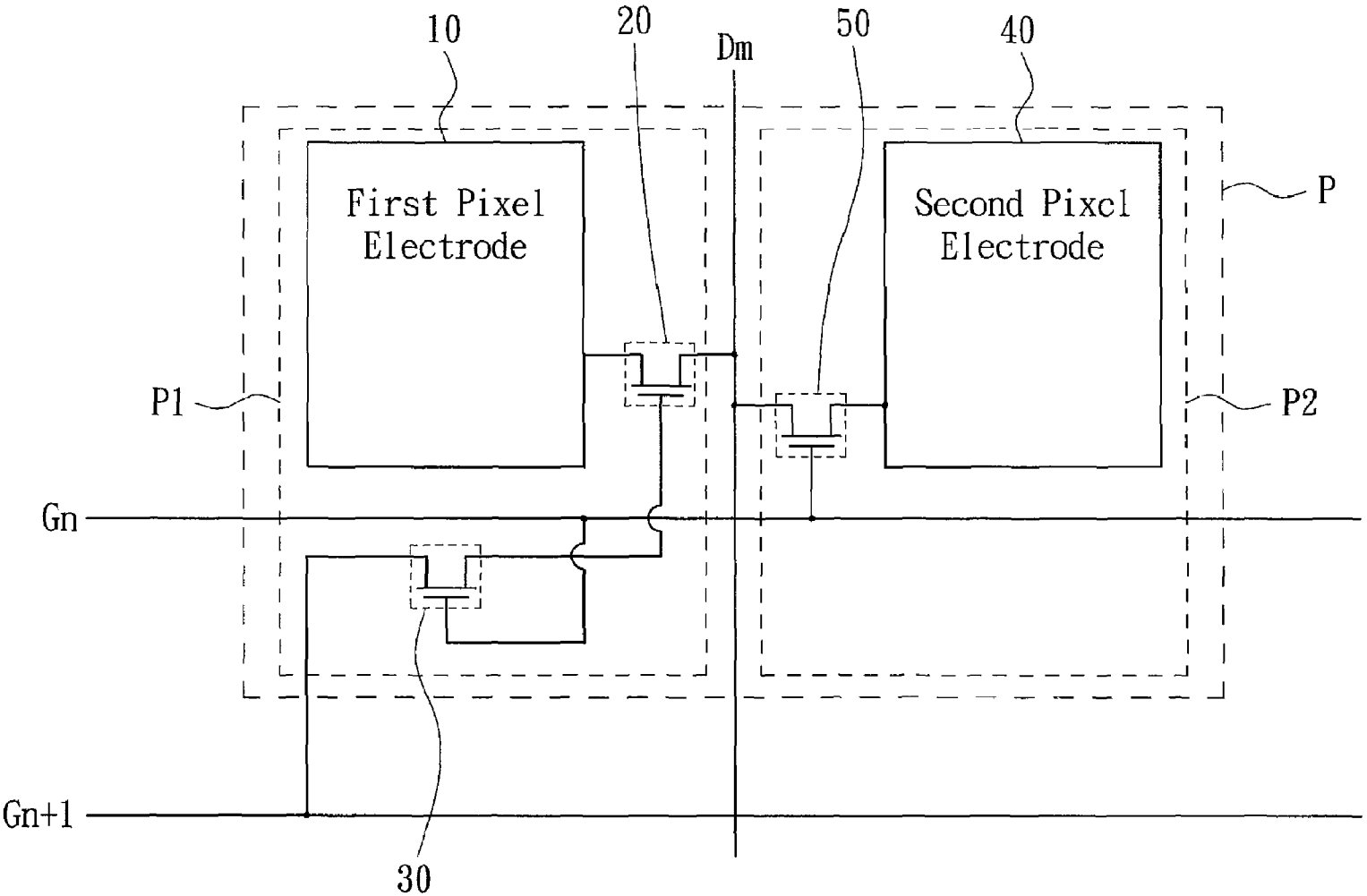
FIG. 4 shows a circuit structure of a pixel in the display area 310 according to FIG. 3.

Referring to FIG. 4, a circuit structure of a pixel in the display area 310 according to FIG. 3 is shown. In the display area 310, all the pixels P comprise a first sub-pixel P1 and a second sub-pixel P2. The pixel P connected to the data line $D_m$ and the scan line $G_n$ in the Nth pixel row $L_n$ is taken for example. The first sub-pixel P1 has a first pixel electrode 10, a first switch 20 and a thin film transistor (TFT) 30. The second sub-pixel has a second pixel electrode 40, and a second switch 50. The first switch 20, the TFT 30 and the second switch 50, for example, are N-type metal oxide semiconductor (NMOS) field effect transistors. In the first sub-pixel P1, the first switch 20 is connected to the first pixel electrode 10 and the corresponding data line $D_m$, and the TFT 30 is connected to the corresponding scan line $G_n$, the next scan line $G_{n+1}$ and the first switch 20. In the second sub-pixel, the second switch 50 is connected the second pixel electrode 40, the scan line $G_n$ and the data line $D_m$. The following description will explain how the embodiment of the invention solves the problem of flickering caused by the pixel multiplexing structure in the conventional flat panel display.

Figure 5:
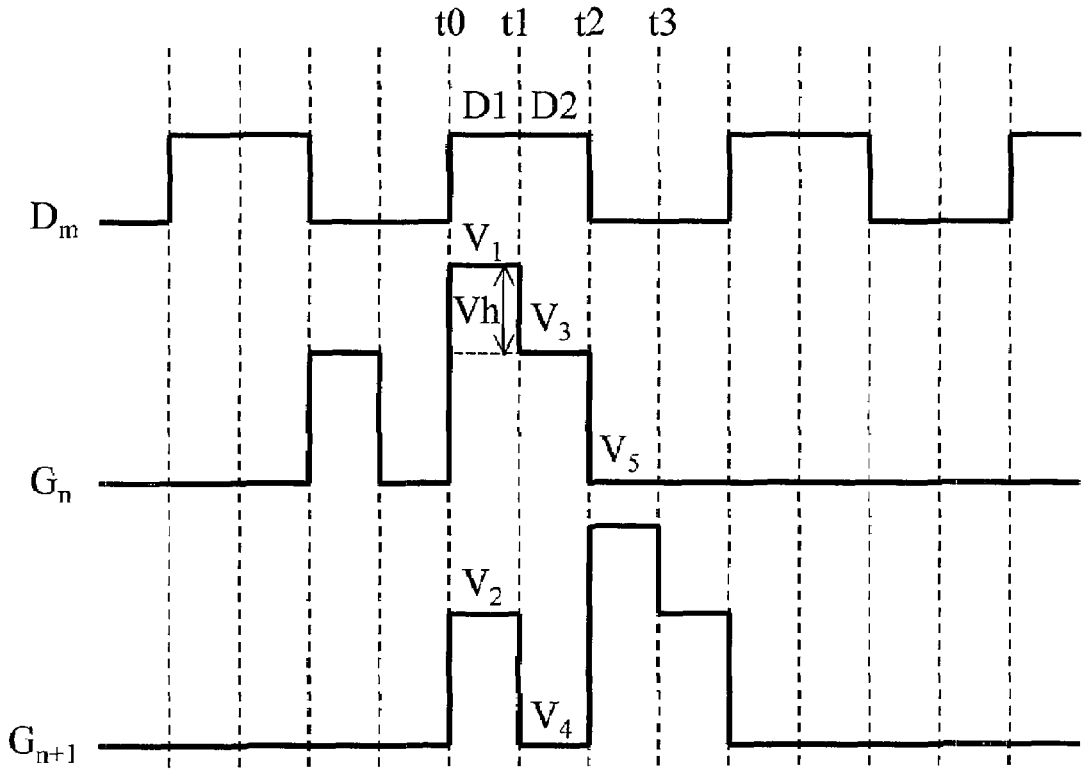
FIG. 5 shows a waveform of the scan line and the data line according to FIG. 4.

Referring to FIG. 5, a waveform of the signals provided to the scan line $G_n$, $G_{n+1}$ and the data line $D_m$ according to FIG. 4 is shown. In the time period from t0 to t1, the scan line $G_n$ outputs a first scan voltage $V_1$ to the Nth pixel row $L_n$ to conduct the corresponding TFT 30. At the same time, the next scan line $G_{n+1}$ outputs a second scan voltage $V_2$ via the conducted TFT 30 to the corresponding first switch 20 to conduct the first switch 20. Then, the corresponding data line $D_m$ outputs a first data voltage $D_1$ via the conducted first switch 20 to the corresponding first pixel electrode 10, and the corresponding pixel frame is displayed according to the first data voltage $D_1$. Besides, the first scan voltage $V_1$ outputted by the scan line $G_n$ conducts the corresponding second switch 50, and the corresponding data line $D_m$ outputs the first data voltage $D_1$ via the conducted second switch 50 to the second pixel electrode 40. It is worthy to notice that the first scan voltage $V_1$ is larger than the second scan voltage $V_2$ (for example equal to 20V) and the difference is at least a threshold voltage Vh (for example equal to 5V) of the TFT 30.

Next, in the time period from t1 to t2, the scan line $G_n$ provides a third scan voltage $V_3$ to the Nth pixel row $L_n$ to conduct the corresponding TFT 30 and the second switch 50, wherein the third scan voltage $V_3$ is substantially equal to the second scan voltage $V_2$. At the same time, the next scan line $G_{n+1}$ provides a fourth scan voltage $V_4$ (for example equal to 0V) through the conducted TFT 30 to the corresponding first switch 20 to turn off the first switch 20. Then, the corresponding data line $D_m$ outputs a second data voltage $D_2$ via the conducted second switch 50 to the corresponding second pixel electrode 40, and the corresponding pixel frame is displayed according to the second data voltage $D_2$.

In order to solve the problem of flickering caused by the unequal charging capability of the two adjacent pixels in the flat panel display with the pixel multiplexing structure mentioned above, in the preferable embodiment of the invention, the first scan voltage $V_1$ is at least a threshold voltage Vh larger than the second scan voltage $V_2$, such that the TFT 30 can be conducted completely by the first scan voltage $V_1$ in the time period from t0 to t1. Then, the second scan voltage $V_2$ (=20V) outputted by the conducted TFT 30 conducts the first switch 20, and then the corresponding data line $D_m$ outputs the first data voltage $D_1$ via the conducted first switch 20 to the first pixel electrode 10. In the time period from t1 to t2, the third scan voltage $V_3$ (=20V) conducts the second switch 50, and then the corresponding data line $D_m$ outputs the second data voltage $D_2$ via the conducted second switch 50 to the second pixel electrode 40. Thus, the gate voltage of the first switch (MOS) 20 is substantially equal to the gate voltage of the second switch (MOS) 50, such that the charging capability of the first sub-pixel P1 equals to that of the second sub-pixel P2. As a result, it solves the problem of flickering efficiently.

In the following time period from t2 to t3, the first scan voltage $V_1$ outputted by the next scan line $G_{n+1}$ drives the pixels in the N+1th pixel row. At the same time, the scan line $G_n$ outputs a fifth scan voltage $V_5$ (for example 0V) in order to turn off the corresponding TFT 30 and the second switch 50.

Figure 6:
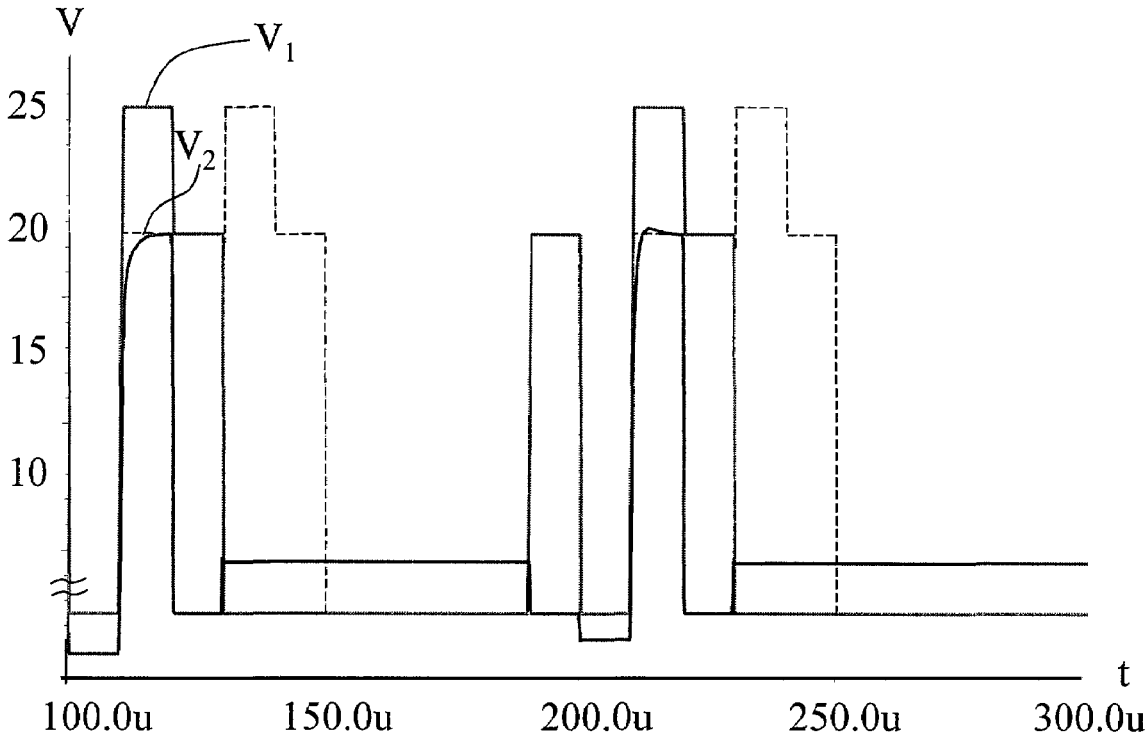
FIG. 6 shows a circuit simulation waveform of the signals provided to the scan line and the data line according to the preferable embodiment of the invention.

Referring to FIG. 6, a waveform of the signals provided to the scan line and the data line according to the circuit simulation of the preferable embodiment of the invention by software is shown. According to the data obtained by the circuit simulation, when the first scan voltage V1 is equal to 25V and both the second scan voltage and the third scan is equal to 20V, the gate voltage of the first switch (MOS) 20 and that of the second switch (MOS) 50 are both equal to 20V so that the first sub-pixel P1 and the second sub-pixel P2 will have the same charging capability.

Figure 7:
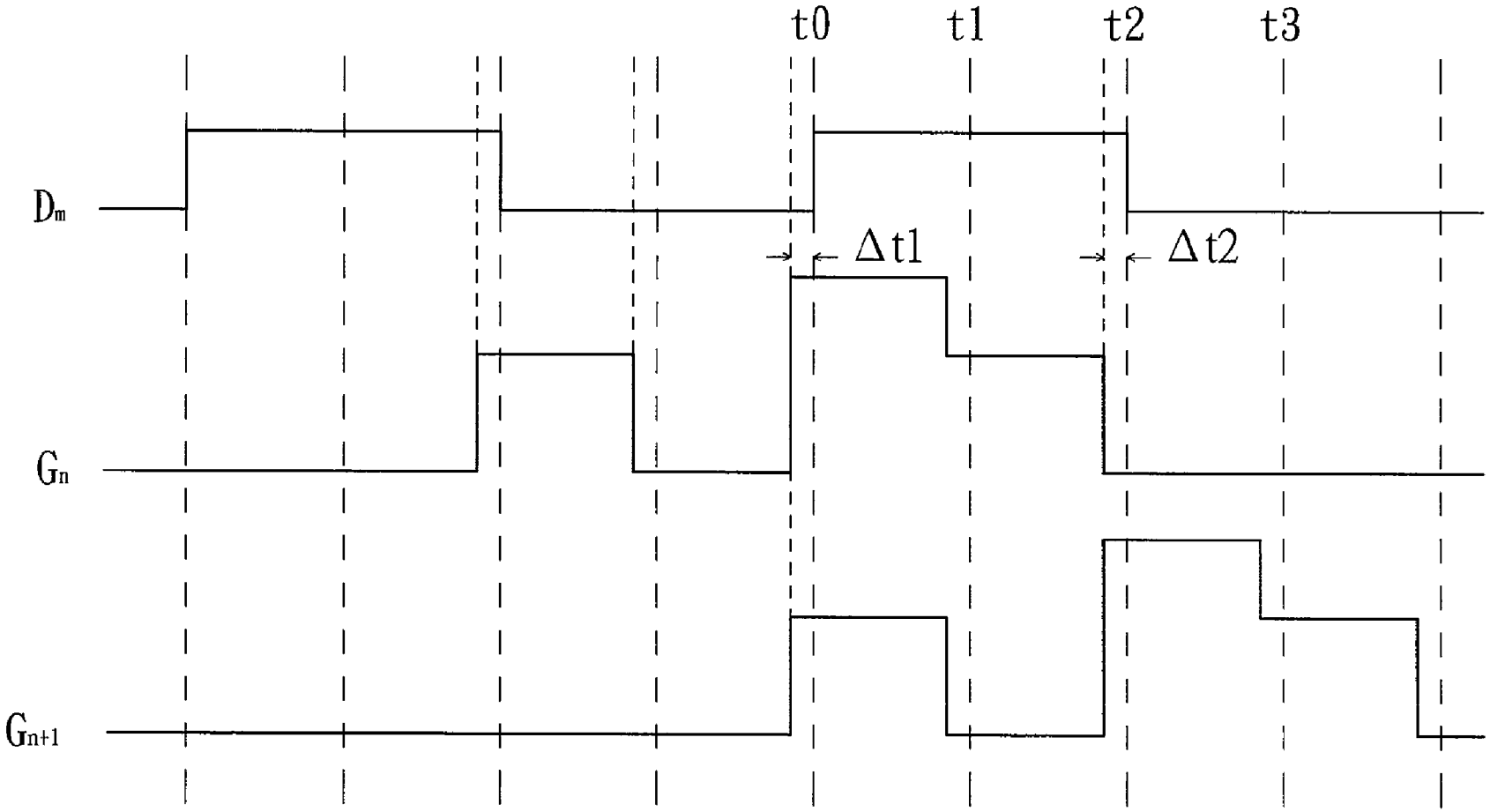
FIG. 7 shows another waveform of the signals provided to the scan line and the data line according to the preferable embodiment of the invention.

In the practical application, the pixel multiplexing driving method of the invention is not limited to the embodiment mentioned above, the timing sequence of the scan lines and the data lines can be adjusted according to the practical requirement. Referring to FIG. 7, another waveform of the signals provided to the scan line and the data line according to the preferable embodiment of the invention is shown. Compared to FIG. 5, at the timing point t0, the scan lines $G_n$ and $G_{n+1}$ output the scan voltages $V_1$ and $V_2$ separately, but the data line $D_m$ does not output the data voltage until a delay time Δt1. At the timing point t2, the scan line outputs the fifth scan voltage $V_5$ and the next scan line $G_{n+1}$ outputs the first scan voltage $V_1$, but the data line $D_m$ does not return to the low-level voltage (for example 0V) until a delay time Δt2. As long as the delay time Δt1 and Δt2 are in an allowable tolerant range in which the image can be displayed normally, the same goal of avoiding the phenomenon of flickering can be achieved.

As mentioned above, in the pixel driving method of the invention, although it is taken for example that the first scan voltage $V_1$ and the second scan voltage $V_2$ are high-level voltages, and the first scan voltage $V_1$ is at least a threshold voltage larger than the second scan voltage $V_2$, the TFT 30, the first switch 20 and the second switch 50 of the invention can be P-type metal oxide semiconductors (PMOS), and the first scan voltage $V_1$ and the second scan voltage $V_2$ are low-level voltages. Moreover, the second scan voltage $V_2$ can still be not equal to the third scan $V_3$. As long as the absolute value of the difference between the first scan voltage $V_1$ and the second scan voltage $V_2$ is not smaller than a threshold voltage of the TFT and the second scan voltage $V_2$ and the third scan voltage $V_3$ can conduct the first switch 20 and the second switch 50 completely, the charging capability of the first sub-pixel P1 and the second sub-pixel P2 is almost the same and the phenomenon of flickering can be avoided.

Figure 8:
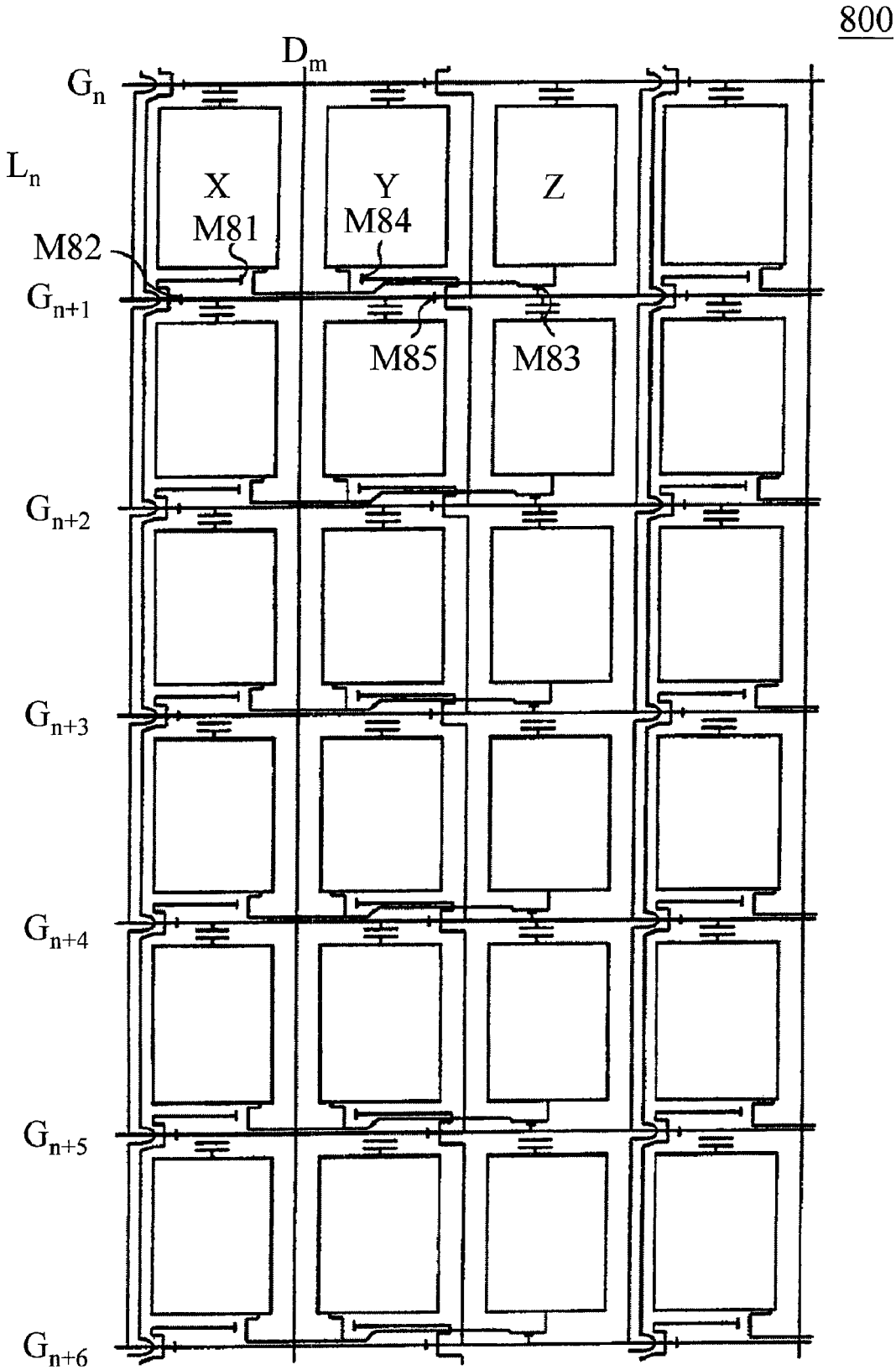
FIG. 8 shows another circuit structure of a pixel according to the preferable embodiment of the invention.
Figure 9:
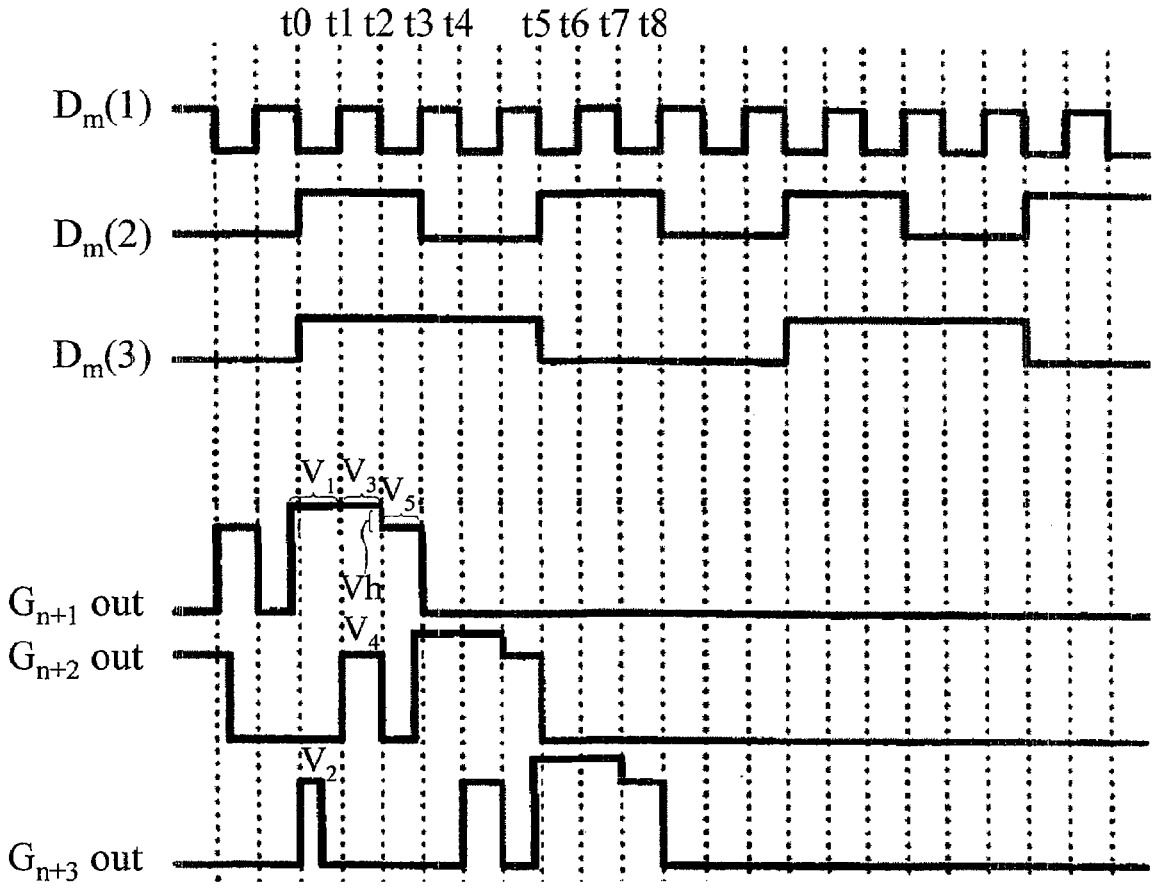
FIG. 9 shows a waveform of the signals provided to the scan line and the data line according to FIG. 8.

Preferably, the pixel multiplexing driving method can be applied to the structure that more than two pixels are connected to the same data line. Referring to FIG. 8, another circuit structure of a pixel according to the preferable embodiment of the invention is shown. Also referring to FIG. 9 which shows a waveform of the signals provided to the scan line $G_n$~$G_{n+5}$ and the data line $D_m$ according to FIG. 8 is shown. In the Nth pixel row $L_n$ of pixel array 800, a pixel X, a pixel Y and a pixel Z are connected to the scan lines $G_n$~$G_{n+3}$ through the TFTs M81~M85 separately, but the pixels X~Z are connected to the same data line $D_m$. In the time period from t0 to t1, the scan lines $G_{n+1}$ and $G_{n+3}$ output the scan voltages $V_1$ and $V_2$ separately, such that the data voltage of the data line $D_m$ is outputted to the corresponding pixel X. In the time period from $t_1$ to $t_2$, the scan lines $G_{n+1}$ and $G_{n+2}$ output the scan voltages $V_3$ and $V_4$ separately, such that the data voltage of the data line $D_m$ is outputted to the corresponding pixel Y. In the time period from t2 to t3, only the scan line $G_{n+1}$ outputs the scan voltage $V_5$, such that the data voltage of the data line $D_m$ is outputted to the corresponding pixel Z. Wherein, the scan voltages $V_2$, $V_4$ and $V_5$ are substantially the same, and the scan voltages $V_1$ and $V_3$ are at least a threshold voltage Vh (for example 5V) larger than the scan voltage $V_2$ (for example 20V), that is $V_1 \geqq V_2 + Vh$. The threshold voltage is the gate voltage of the TFT which allows the scan voltages $V_1$ and $V_3$ conduct the TFTs M82 and M85 completely, such that the pixels X~Z have the same charging ability in order to avoid the phenomenon of flickering efficiently.

The flat panel display disclosed in the embodiment of the invention is adopted by the pixel multiplexing driving method that adjusts the scan voltages of the adjacent two scan lines driving the same pixel, such that the absolute value of the difference between the previous scan voltage and the next scan voltage is not smaller than a threshold voltage of the pixel transistor. Therefore, the adjacent two sub-pixels in the same pixel can reach the same charging capability, and then improve the problem of flickering in the conventional flat panel display.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A pixel driving method applied to a flat panel display, the flat panel display having a plurality of pixels, a plurality of scan lines, a plurality of data lines, each pixel having a first sub-pixel and a second sub-pixel, each first sub-pixel having a first pixel electrode, a first switch and a thin film transistor (TFT), each second sub-pixel having a second pixel electrode and a second switch, the first switch of each pixel connected to the first pixel electrode and the corresponding data line, the TFT of each pixel connected to the corresponding scan line, the next scan line and the first switch, the second switch of each pixel connected the second pixel electrode, the corresponding scan line and the corresponding data line, the pixel driving method comprising:

in a first time period, providing a first scan voltage to a pixel row among the pixels by the corresponding scan line to conduct the corresponding TFTs, and providing a second scan voltage through the conducted TFTs to the corresponding first switches by the next scan line to conduct the first switches, and then transmitting a plurality of first data voltages to the corresponding first pixel electrodes by the corresponding data lines, wherein the absolute value of the difference between the first scan voltage and the second scan voltage is not smaller than a threshold voltage of the TFTs, and in a second time period, providing a third scan voltage to the pixel row by the corresponding scan line to conduct the corresponding TFTs and the corresponding second switches, and providing a fourth scan voltage through the conducted TFTs to the corresponding first switches by the next scan line to turn off the first switches, at the same time, outputting a plurality of second data voltages of the corresponding data lines via the conducted second switches to the corresponding second pixel electrodes.

2. The pixel driving method according to claim 1 further comprising:

in the first time period, conducting the corresponding second switches by the first scan voltage provided by the corresponding scan line, and outputting the first data voltages of the corresponding data lines via the conducted second switches to the second pixel electrodes.

3. The pixel driving method according to claim 1 further comprising:

in a third time period, providing a fifth scan voltage to the pixel row by the scan line to turn off the corresponding TFTs and the second switches.

4. The pixel driving method according to claim 3, wherein the first scan voltage and the second scan voltage are both high-level voltages, and the difference between the first scan voltage and the second scan voltage is substantially equal to the threshold voltage.

5. The pixel driving method according to claim 4, wherein the fourth scan voltage and the fifth scan voltage are both low-level voltages, and the fourth scan voltage is substantially equal to the fifth scan voltage.

6. The pixel driving method according to claim 5, wherein the second scan voltage is substantially equal to the third scan voltage.

7. The pixel driving method according to claim 1, wherein the TFT and the first switch and the second switch of the pixels are metal oxide semiconductor (MOS) field effect transistors.

8. A flat panel display comprising:

a substrate having a plurality of scan lines and a plurality of data lines;

a display area having a plurality of pixels sited on the substrate and correspondingly connected to the scan lines and the data lines, each pixel having:

a first sub-pixel having:

a first pixel electrode;

a first switch connected to the first pixel electrode and the corresponding data line; and a thin film transistor (TFT) connected to the corresponding scan line, the next scan line and the first switch;

a second sub-pixel having:

a second pixel electrode; and a second switch connected to the second pixel electrode, the corresponding scan line and the corresponding data line;

wherein in a first time period, the scan line outputs a first scan voltage to a pixel row among the pixels to conduct the corresponding TFTs, the next scan line also outputs a second scan voltage via the conducted TFTs to the corresponding first switches to conduct the first switches, and a plurality of first data voltages are transmitted to the corresponding first pixel electrodes through the corresponding data lines and the conducted first switched, and the absolute value of the difference between the first scan voltage and the second scan voltage is not smaller than a threshold voltage of each TFT;

wherein in a second time period, the scan line provides a third scan voltage to the pixel row to conduct the corresponding TFTs and the second switches, the next scan line also provides a fourth scan voltage through the conducted TFTs to the corresponding first switches to turn off the first switches, at the same time, the corresponding data lines output a plurality of second data voltages via the conducted second switches to the corresponding second pixel electrodes.

9. The flat panel display according to claim 8, wherein in the first time period, the first scan voltage outputted by the scan line conducts the second switches, and then the corresponding data lines output the first data voltages via the conducted second switches to the second pixel electrodes.

10. The flat panel display according to claim 8, wherein in a third time period, the scan line outputs a fifth scan voltage to the pixel row to turn off the corresponding TFTs and the second switches.

11. The flat panel display according to claim 10, wherein the difference between the first scan voltage and the second scan voltage is substantially equal to the threshold voltage.

12. The flat panel display according to claim 11, wherein the fourth scan voltage is substantially equal to the fifth scan voltage.

13. The flat panel display according to claim 12, wherein the second scan voltage is substantially equal to the third scan voltage.

14. The flat panel display according to claim 8, wherein the TFT and the first switch and the second switch of the pixels are metal oxide semiconductor (MOS) field effect transistors.

15. The flat panel display according to claim 8, wherein the flat panel display is a liquid crystal display (LCD).

* * * * *